United States Patent [19]

Worby et al.

[11] Patent Number: 4,887,944

[45] **Date of Patent: * Dec. 19, 1989**

[54] FUEL INJECTION PUMP INCLUDING PLUNGER SETTING DEVICE

[75] Inventors: Donald Worby, Stonehouse; Gerald S. Thomas, Longlevens, both of United Kingdom

[73] Assignee: Lucas Industries Public Limited Company, United Kingdom

[ * ] Notice: The portion of the term of this patent subsequent to Mar. 19, 2004 has been disclaimed.

[21] Appl. No.: 226,515

[22] Filed: Jan. 19, 1981

[30] Foreign Application Priority Data

Jan. 29, 1980 [GB] United Kingdom ..... 8003017

[51] Int. Cl.[4] ..... F02M 59/44

[52] U.S. Cl. ..... 417/490; 92/15

[58] Field of Search ..... 123/495, 500, 501, 503, 123/509; 92/15; 239/88, 89; 417/499, 494, 490

[56] References Cited

U.S. PATENT DOCUMENTS

| | | | |
|---|---|---|---|
| 2,315,907 | 4/1943 | Starr | 239/88 X |
| 2,650,543 | 9/1953 | Pauget | 417/214 |
| 3,702,577 | 11/1972 | Staudt et al. | 123/495 X |
| 4,142,498 | 3/1979 | Hammond | 123/501 |

FOREIGN PATENT DOCUMENTS

| | | | |
|---|---|---|---|
| 2069624 | 8/1981 | United Kingdom | 123/495 |

*Primary Examiner*—Leonard E. Smith

[57] ABSTRACT

A fuel injection pump for supplying fuel to internal combustion engines includes a pump plunger slidable within a bore in a pump body. The plunger is actuated by a rocker mechanism directly by the associated engine and in order to adjust the mechanism the plunger must be set at a known position. This is determined by a spring loaded pin contained within a housing, the pin can be depressed to engage with the side wall of a groove in the plunger to set the plunger at the predetermined position.

1 Claim, 2 Drawing Sheets

FUEL INJECTION PUMP INCLUDING PLUNGER SETTING DEVICE

This invention relates to fuel injection pumps for supplying fuel to internal combustion engines and of the kind comprising a pump body from which extends a pump plunger, resilient means acting to urge the plunger outwardly of the body and a thrust assembly mounted at the outer end of the plunger.

Such a pump is intended to be mounted on an engine and to be actuated by a mechanism forming part of the engine for example, a rocker which is actuated by a cam shaft of the engine, in a similar fashion to the inlet and exhaust valves of the engine. It is well known with such pumps that the plunger must be moved inwardly to a predetermined position before delivery of fuel by the pump will take place, the predetermined position being determined by the closure of a port by the plunger. The commencement of delivery of fuel to an engine is critical to the correct functioning of the engine and because of manufacturing tolerances it is necessary to provide some means in the mechanism for effecting adjustment of the timing of commencement of delivery. One known method of adjustment is to provide an adjusting screw on the rocker and when carrying out the adjustment, to ensure firstly that the plunger is in a known position and secondly that the engine is in a known position. Once the plunger and engine have been placed in the known positions, the screw is screwed in to take up the clearance and is then locked.

The plunger is not provided with any form of stop whereby it assumes or can be pushed to a known position, however it is known to provide a setting device which can be located in position on the body of the pump when it is required to carry out the adjustment, and which has a part engageable with the plunger or the thrust assembly to set the thrust assembly and/or the plunger at a known position. The setting device represents an extra item of equipment which can be lost or damaged.

The object of the present invention is to provide a pump of the kind specified in a form in which setting of the timing of delivery of fuel in use is facilitated.

According to the invention in a pump of the kind specified, the plunger is provided with a recess and the body mounts a resiliently loaded pin for engagement upon depression of the pin, within said recess thereby to set the plunger at a known position relative to the body.

Reference will now be made to the accompanying drawings in which.

Figure 1:
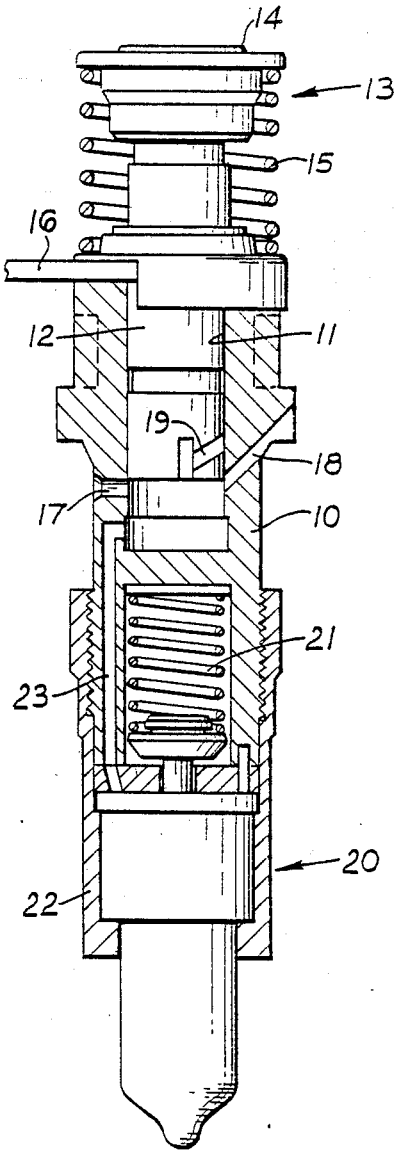
FIG. 1 shows a sectional side elevation of one example of a pump to which the invention may be applied.

In the drawings the pump body is indicated at 10 and is of generally cylindrical form. Extending into the body from one end thereof is a cylindrical bore 11 in which is located a reciprocable pumping plunger 12. The plunger extends from the body and mounts a thrust assembly generally indicated at 13 and which includes a thrust pad 14 which in use, is engaged by a rocker which will impart inward movement to the plunger. The thrust assembly also constitutes the abutment for one end of a coiled spring 15 which acts to urge the plunger in the outward direction.

The plunger in known manner is movable angularly and for this purpose an arm 16 is provided which is provided with a non-circular aperture through which extends a complementarily shaped portion of the plunger whereby angular movement of the arm will impart angular movement to the plunger but the latter can move axially relative to the arm.

The body is provided with an inlet passage 17 which extends radially from the bore 11 and also a spill passage 18 which in the particular example, is inclined. The inner ends of both passages are arranged to be covered by the plunger during the inward movement thereof and when the ends of the passages are just covered, fuel will be displaced from the bore 11 during continued inward movement of the plunger. Formed on the plunger is a helical groove 19 which after a predetermined movement determined by the angular setting of the plunger, registers with the spill port 18 and the remaining fuel in the bore which is displaced, flows through the spill passage 18 to a fuel supply gallery. The supply gallery is constituted by an enlargement of a bore in the cylinder head of the engine with which the pump is associated.

The pump shown in FIG. 1 has combined with it a fuel injection nozzle and this is generally indicated at 20 and it contains in known manner, a fuel pressure actuated valve member which is biased by means of a spring 21 which is located in a chamber defined in the body 10. The nozzle 20 is retained by means of a cap nut 22 which is in screw thread engagement with the body and the inner end of the bore 11 communicates with a fuel inlet of the nozzle by way of a passage 23. It will be understood that the pump and the nozzle are located in a bore in the cylinder head of an engine in such a manner that the end of the nozzle assembly remote from the tappet assembly 13 is exposed to the combustion chamber of the engine.

As previously mentioned fuel will flow through the passage 23 as soon as the passages 17 and 18 are covered by the plunger during its inward movement. In order to ensure that delivery of fuel occurs at the correct time it is necessary to "time" the pump relative to the engine and for this purpose it is necessary to position the plunger at a predetermined position which need not be the position of the plunger at which the ports 17 and 18 are just covered. Providing the aforesaid predetermined position is known and the engine position is known then the rocker which engages the thrust member 14, can be adjusted.

Figure 2:
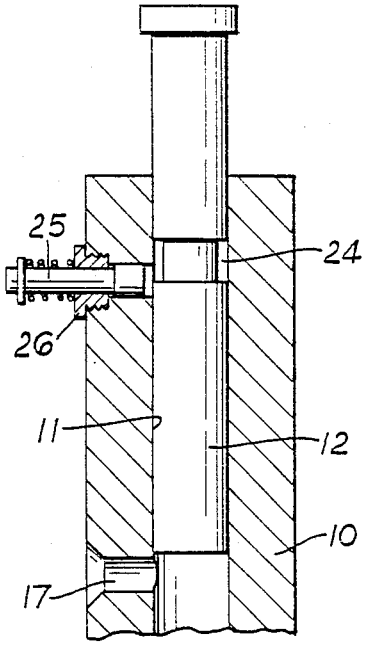
FIG. 2 is a simplified cross-section of part of the pump shown in FIG. 1 and modified in accordance with the invention.
Figure 3:
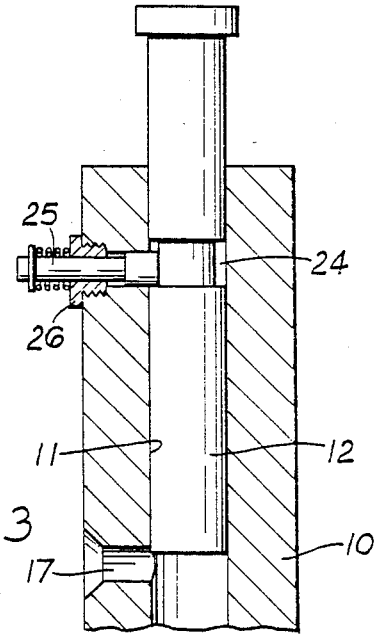
FIG. 3 is a view similar to FIG. 1 showing the plunger in a predetermined position as determined by the adjusting device.

As shown in FIG. 2 the plunger 12 is provided with a circumferential groove 24 and this is a special groove provided for the purpose. Moreover, mounted on the body is a spring loaded pin 25 which is located in a housing 26 and which can be depressed so that it can locate within the recess defined by the groove 24. The housing 26 is in screw thread engagement with the pump body.

One method of adjusting the rocker is to set the engine at the known position and then unscrew the adjusting screw to allow the pump to be assembled to the engine and clamped therein. The adjusting screw is then tightened during which time the pumping plunger 12 is moved inwardly. The pin 25 is pressed inwardly so that it engages the side of the pumping plunger and when the pin 25 moves into the circumferential groove tightening of the adjusting screw is discontinued, the screw then being locked.

An alternative way is to place the plunger at the predetermined position by moving the plunger inwardly and at the same time applying pressure to the pin 25 so that as soon as the plunger 12 is in the predetermined position, the pin 25 can enter the recess. Pressure is maintained upon the pin 25 and the main plunger 12 allowed to move under the action of the spring 15 so that the inner end of the pin 25 engages the side wall of the groove 24. The force exerted by the spring 15 is sufficient to retain the pin 25 at its innermost position. With the engine moved to its predetermined position, adjustment of the rocker can take place and as soon as inward movement is imparted to the plunger 12 and the pin 25 will move outwardly under the action of its own spring.

Figure 4:
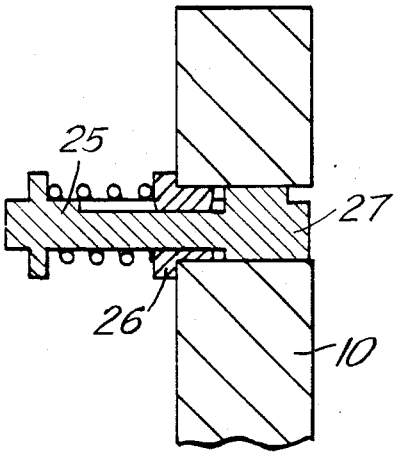
FIG. 4 is a simplified cross-section of part of the pump showing a further modification of the invention.

In some instances it is desirable to be able to adjust the predetermined position, this can be achieved by providing the pin 25 with an eccentrically disposed portion 27 for engagement with the edge of the groove 24 as shown in FIG. 4. The pin 25 is retained against angular movement within its housing 26 and the housing is a push fit in the pump body, the two being retained by a suitable cement. Before the housing 26 is pushed into position the pump plunger is located in the pump body using a jig.

By virtue of the fact that the pump plunger locating device is part of the pump assembly it cannot be detached therefrom and be lost or damaged.

We claim:

1. A fuel injection pump for supplying fuel to internal combustion engines comprising a pump body from which extends a pump plunger, resilient means acting to urge the plunger outwardly, a thrust assembly mounted at the outer end of the plunger, a recess on the plunger, and a resiliently loaded pin mounted in a housing carried by the pump body for engagement upon depression of the pin, within said recess to set the plunger at a known position relative to the body, said pin being retained against angular movement in its housing, the end portion of the pin being eccentrically disposed, and the housing of the pin and the pump body being cemented together.

* * * * *